US005099526A

United States Patent [19]

Baena

[11] Patent Number: 5,099,526

[45] Date of Patent: Mar. 31, 1992

[54] RAINCOAT

[76] Inventor: Jose M. Baena, 2414 S.W. 99th Ct., Miami, Fla. 33154

[21] Appl. No.: 727,028

[22] Filed: Jul. 8, 1991

Related U.S. Application Data

[63] Continuation-in-part of Ser. No. 544,636, Jun. 27, 1990.

[51] Int. Cl.[5] ..... A41D 3/08

[52] U.S. Cl. ..... 2/88; 2/84; 2/89; 2/243 B; 2/DIG. 5

[58] Field of Search ..... 2/88, 89, 243 B, 243 R, 2/DIG. 5, 84

[56] References Cited

U.S. PATENT DOCUMENTS

| | | | |
|---|---|---|---|
| 1,576,023 | 3/1926 | Barberis | 2/84 |
| 1,603,501 | 10/1926 | Yenn | 2/88 |
| 1,641,039 | 8/1927 | Beaud | 2/84 |
| 1,710,778 | 4/1929 | Luhn | 2/88 |
| 1,864,948 | 6/1932 | Schmidt | 2/88 |
| 2,072,644 | 3/1937 | McBee | 2/84 |
| 2,667,641 | 2/1954 | Finnegan | 2/88 |
| 2,711,538 | 6/1955 | Cordero | 2/84 |
| 2,734,195 | 2/1956 | Moss | 2/84 |
| 2,911,651 | 11/1959 | Nye | 2/84 |
| 3,111,677 | 11/1963 | Artzt | 2/84 |
| 3,161,887 | 12/1964 | Silver | 2/88 |
| 3,522,612 | 8/1970 | Palmer | 2/88 |
| 3,946,443 | 3/1976 | Knight | 2/82 |
| 4,055,852 | 11/1977 | Wallace | 2/84 |
| 4,067,067 | 1/1978 | Neuls | 2/84 |
| 4,118,802 | 10/1978 | Polster | 2/84 |
| 4,313,229 | 2/1982 | Villafane | 2/84 |
| 4,370,755 | 2/1983 | Crumby | 2/88 |
| 4,390,096 | 6/1983 | Goldenberg | 2/84 |
| 4,426,740 | 1/1984 | Reverberi | 2/84 |
| 4,783,856 | 11/1988 | Bouwens et al. | 2/87 |

*Primary Examiner*—Werner H. Schroeder
*Assistant Examiner*—Gloria Hale
*Attorney, Agent, or Firm*—Sanchelima & Assoc.

[57] ABSTRACT

A raincoat made out of a continuous folded web forming a subtantially rectangular shape with two long sides and two short sides. A sealed portion extends perpendicular to the fold that defines one of the long sides and extends a distance that is comparable to the diameter of the head of the user. Two parallel and spaced apart longitudinal cuts extend perpendicular to one of the short ends to define a pair of straps for the hood when the sheet is separated from the web and unfolded. A second pair of straps is formed by a third cut that extends perpendicular to the cut that is farther away from the fold. A user ends up with a raincoat that effectively protects him or her from the rain.

4 Claims, 2 Drawing Sheets

RAINCOAT

OTHER RELATED APPLICATIONS

The present application is a continuation-in-part pending of U.S. patent application Ser. No. 544,636, filed on June 27, 1990, which is hereby incorporated by reference.

BACKGROUND OF THE INVENTION

1. Field of the Invention

The present invention relates to a raincoat made out of a thin flexible sheet, and more particularly, to a raincoat that can be easily adapted to high production manufacturing processes including a continuous web of the flexible material.

2. Description of the Related Art

Several designs of raincoats have been designed in the past. However, these raincoats require a number of relatively complex operations for their manufacture. One of these designs is disclosed in U.S. Pat. No. 4,118,802 issued to Polster in 1978. It requires a considerable number of cuts and it is not universally adaptable to users wearing different sizes.

Applicant believes that another pertinent reference corresponds to U.S. Pat. No. 4,067,067 issued to Neuls in 1978. However, it differs from the present invention because it requires a substantial number of additional secondary operations.

Finally, U.S. Pat. No. 4,783,856 issued to Bouwens in 1988 is adaptable to a high production manufacturing process that utilizes a continuous web but the design fails to protect a user's head from the rain.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a raincoat that can be manufactured inexpensively from a continuous web of folded sheet of flexible material with water repellent characteristics.

It is another object of the present invention to provide such a rain coat that will effectively protect a user from the rain.

It is still another object of this invention to provide such a raincoat that does not require any additional secondary operations as it is separated from the web.

It is yet another object of the invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
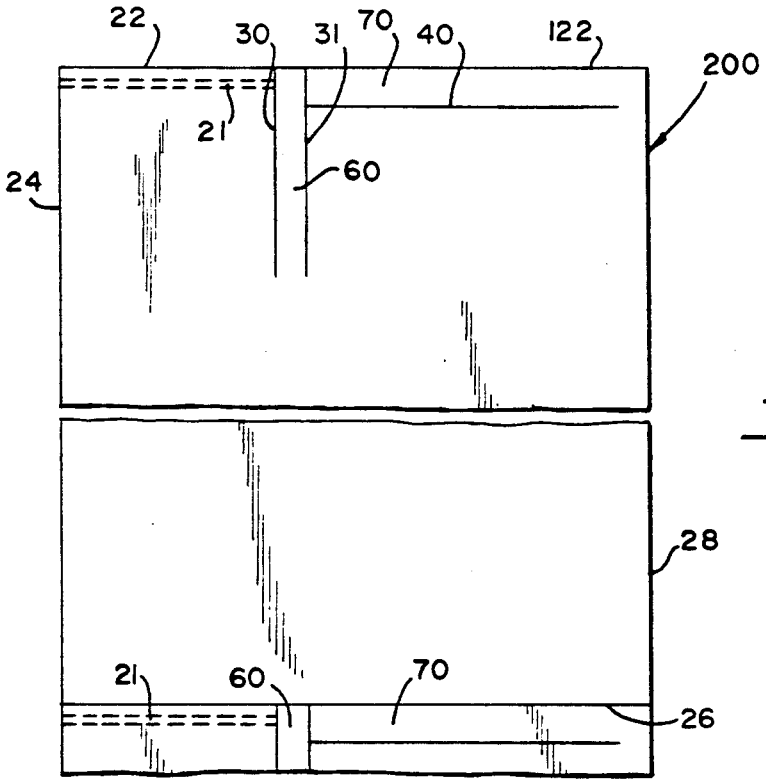
FIG. 1 represents a broken top view of the present invention showing two perpendicular cuts on one end of one of the segments of a continuous web that is folded.
Figure 2:
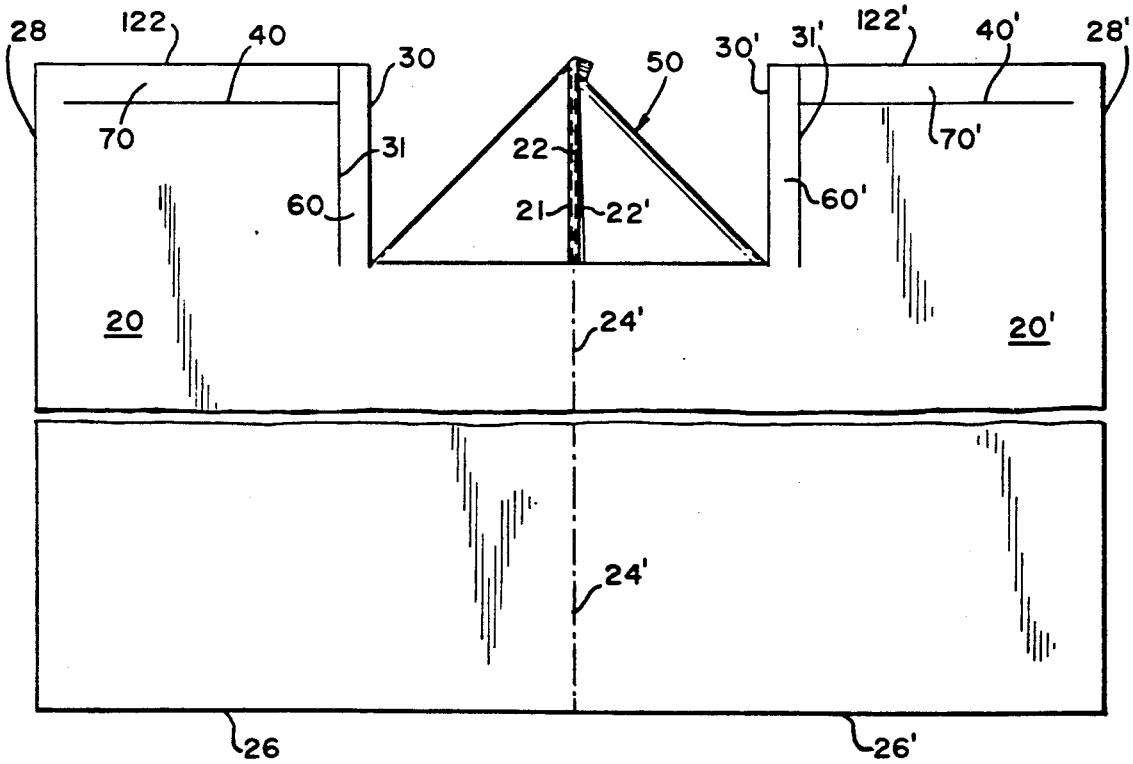
FIG. 2 shows the unfolded rain coat of FIG. 1 showing the hood for the raincoat flat and having a triangular shape.

Referring to FIG. 1 where the web of the folded sheet material web 200 is shown with sides 22, 24, 26 and 28. To facilitate the description of the present invention, the prime numerals, refer to the folded longitudinal half 20' below the upper longitudinal half 20. An imaginary central line 24' corresponds to side 24 when folded. Web 200 is preferably made out of a water repellent material and with flexible characteristics. Waterproof is considered, for the purposes of this application, to be included in the group of water-repellent materials, Cut 30 forms the hood. Cuts 31 and 40 form the straps as shown in FIG. 2. Thermal seal 21 brings together the abutting upper and central side 22 and 22' (not seen in FIG. 1 since it is below 22) of web 20 thereby forming hood 50, as best shown in FIG. 2.

It can be seen in FIG. 2 that upper longitudinal half 20 is unfolded to the left leaving half 20' to the right. Symmetrical and opposite cuts 30; 30'; 31; 31'; 40; and 40'; are shown forming chin straps 60 and 60' and body straps 70 and 70'.

Figure 3:
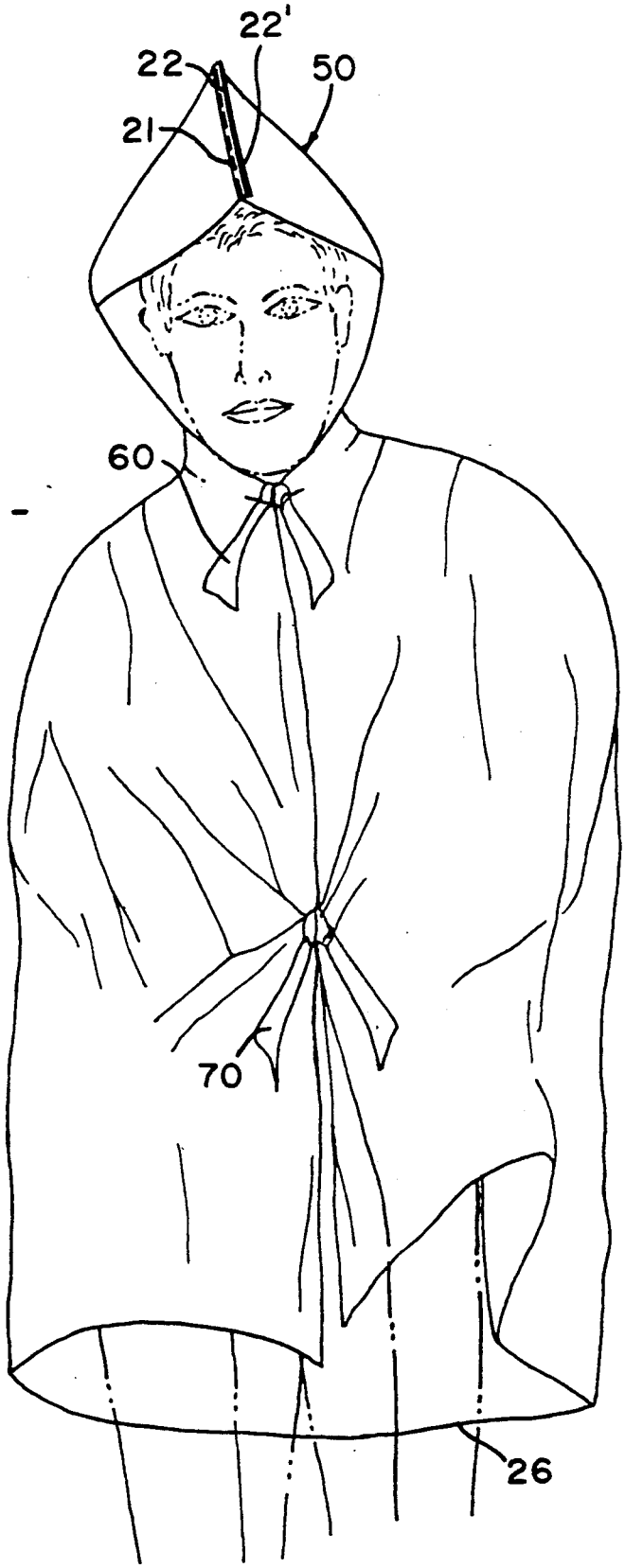
FIG. 3 is a pictorial representation of the present invention being used.

FIG. 3 represents a user wearing rain coat 10 and showing chin strap 60 and body strap 70 tied thereby providing effective protection against the rain. The dimensions of web 200 can vary in length and width.

Raincoat 10 is a simple construction and it can be readily made from conventional garbage bags if desired. All that is required is to place the bag flat on a table and cut longitudinally along the side of the bag all the way down to the bottom. At that point, cuts 30; 31 and 40 are preformed in order to form straps 60 and 70 and hood 50. Therefore, if the rain coat is to be manufactured in high quantities the technology already exists from the plastic bag manufacturing processes to manufacture these raincoats simply. It would only require one of the sides of the plastic bag web to be open and the raincoats are produced in separable segments.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A raincoat made out of a flexible sheet having substantially a rectangular shape when folded and having two long sides and two short sides wherein one of said long sides is defined by a longitudinal fold and including a sealed portion that extends perpendicularly to said longitudinal fold substantially adjacent to one of said short sides and said sealed portion extends a distance that is substantially the same as the diameter of a user's head and said folded sheet further including first and second longitudinal cuts that run parallel and spaced apart to each other and perpendicularly to said short side at the end of said sealed portion so that when said sheet is unfolded a hood and a first pair of straps are formed.

2. The raincoat set forth in claim 1 wherein said second longitudinal cut is farther away from said longitudinal fold and said sheet further including a third longitudinal cut that extends perpendicularly from said second cut towards the long side not having the fold and said third cut not reaching same so that a second pair of straps is formed when said sheet is unfolded.

3. The raincoat set forth in claim 2 wherein said sheet is a separable segment of a continuous web.

4. The raincoat set forth in claim 3 wherein said sheet is made out of a water-repellent material.

* * * * *